US011450168B2

(12) United States Patent
Ishino et al.

(10) Patent No.: US 11,450,168 B2
(45) Date of Patent: Sep. 20, 2022

(54) PRODUCT ACCOMMODATING DEVICE

(71) Applicant: THE COCA-COLA COMPANY, Atlanta, GA (US)

(72) Inventors: Yuji Ishino, Kanagawa (JP); Yasuo Nakazato, Tokyo (JP); Yasuhiro Yamazaki, Tokyo (JP); Takashi Nishiyama, Tokyo (JP)

(73) Assignee: THE COCA-COLA COMPANY, Atlanta, GA (US)

( * ) Notice: Subject to any disclaimer, the term of this patent is extended or adjusted under 35 U.S.C. 154(b) by 0 days.

(21) Appl. No.: 17/255,285

(22) PCT Filed: Jun. 24, 2019

(86) PCT No.: PCT/JP2019/024983
§ 371 (c)(1),
(2) Date: Dec. 22, 2020

(87) PCT Pub. No.: WO2020/004341
PCT Pub. Date: Jan. 2, 2020

(65) Prior Publication Data

US 2021/0272410 A1 Sep. 2, 2021

(30) Foreign Application Priority Data

Jun. 27, 2018 (JP) ..... JP2018-121647

(51) Int. Cl.
*G07F 11/32* (2006.01)
*G07F 9/10* (2006.01)
(Continued)

(52) U.S. Cl.
CPC ..... *G07F 9/105* (2013.01); *F25D 17/067* (2013.01); *G07F 11/10* (2013.01); *G07F 11/32* (2013.01);
(Continued)

(58) Field of Classification Search
USPC ..... 221/150 HC
See application file for complete search history.

(56) References Cited

U.S. PATENT DOCUMENTS 5,080,256 A * 1/1992 Rockola ..... G07F 11/34 193/2 A
6,327,867 B1 12/2001 Hyodo et al.
(Continued)

FOREIGN PATENT DOCUMENTS

JP H04267498 A 9/1992
JP 6-76153 A 3/1995
(Continued)

OTHER PUBLICATIONS

CN Office Action, 2097-2018493PCT, dated Dec. 2, 2021 (15 pp.).
(Continued)

*Primary Examiner* — Gene O Crawford
*Assistant Examiner* — Ayodeji T Ojofeitimi
(74) *Attorney, Agent, or Firm* — Eversheds Sutherland (US) LLP

(57) ABSTRACT

An automatic vending machine is provided with a storage compartment or the like having a thermally insulating construction in which a number of product columns for accommodating products aligned side-by-side in one column are provided in different levels in such a way that the most downstream products in each product column are aligned side-by-side in a vertical direction, and an in-compartment fan for cooling an internal atmosphere of the storage compartment or the like by blowing air that has been cooled by means of an evaporator disposed in the storage compartment or the like, wherein the automatic vending machine is also provided with a control unit which drives the in-compartment fan for a predefined time if the internal temperature of the storage compartment or the like reaches to or above a
(Continued)

predefined reference temperature in a state in which driving of a freezer and of the in-compartment fan are stopped.

7 Claims, 5 Drawing Sheets

(51) Int. Cl.
*F25D 17/06* (2006.01)
*G07F 11/10* (2006.01)

(52) U.S. Cl.
CPC .. *F25D 2331/803* (2013.01); *F25D 2331/805* (2013.01)

(56) References Cited

U.S. PATENT DOCUMENTS

| | | | | |
|---|---|---|---|---|
| 2009/0090734 | A1* | 4/2009 | Wittern, Jr. ..... | G07F 9/105 221/1 |
| 2010/0115972 | A1 | 5/2010 | Lee et al. | |

FOREIGN PATENT DOCUMENTS

| | | | |
|---|---|---|---|
| JP | 2007-286999 | A | 11/2007 |
| JP | 2010-55172 | A | 3/2010 |
| JP | 2015000303 | A | 1/2015 |
| JP | 2015018386 | A | 1/2015 |
| JP | 5915364 | B2 | 5/2016 |
| JP | 2018026089 | A | 2/2018 |

OTHER PUBLICATIONS

International Search Report and Written Opinion, PCT/JP2019/024983, dated Aug. 27, 2019 (7 pp.).
Extended EP Search Report, EP19824712.4, dated Feb. 28, 2022 (7 pp.).

* cited by examiner

[Figure 1]
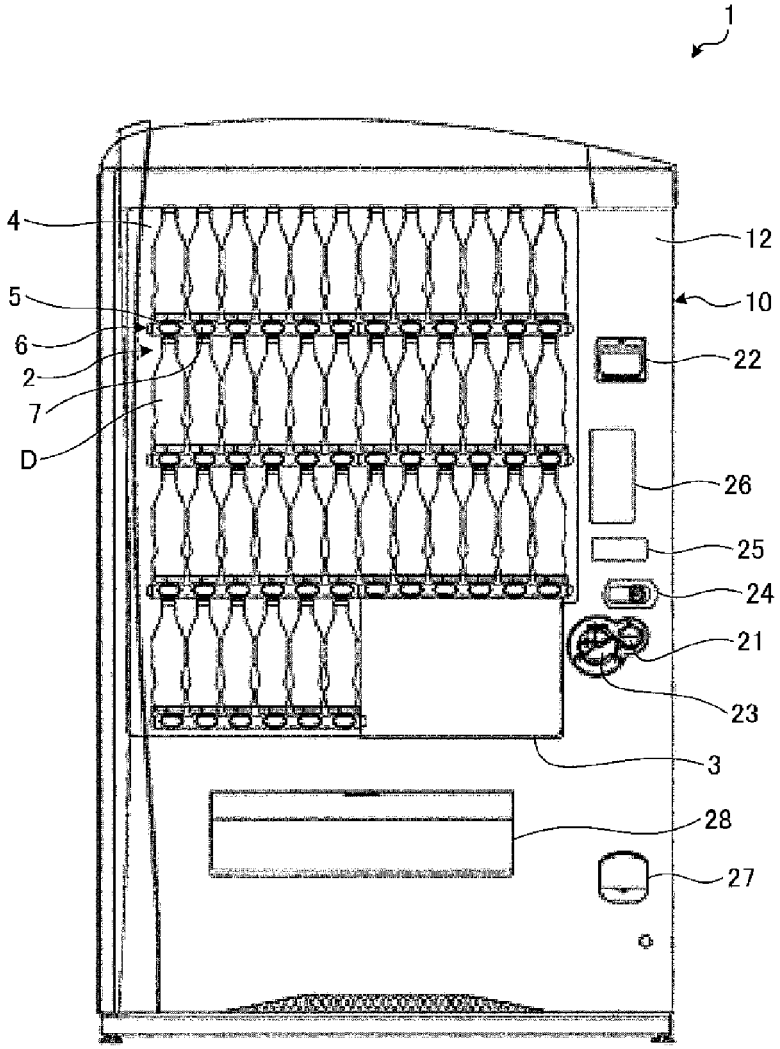

[Figure 2]
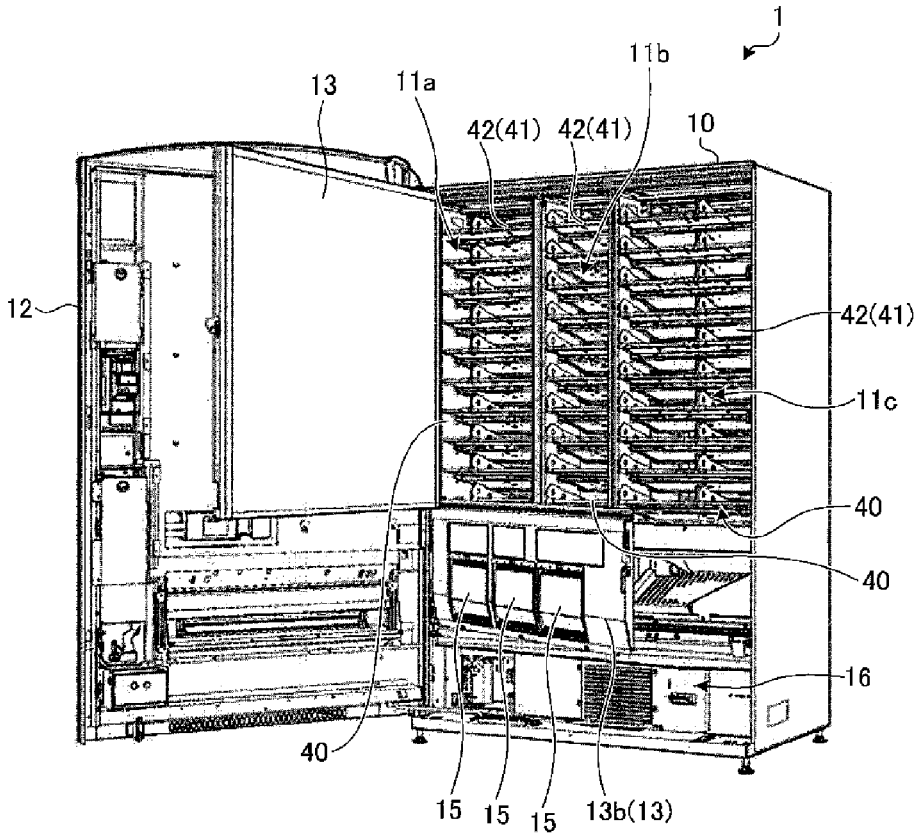

[Figure 3]
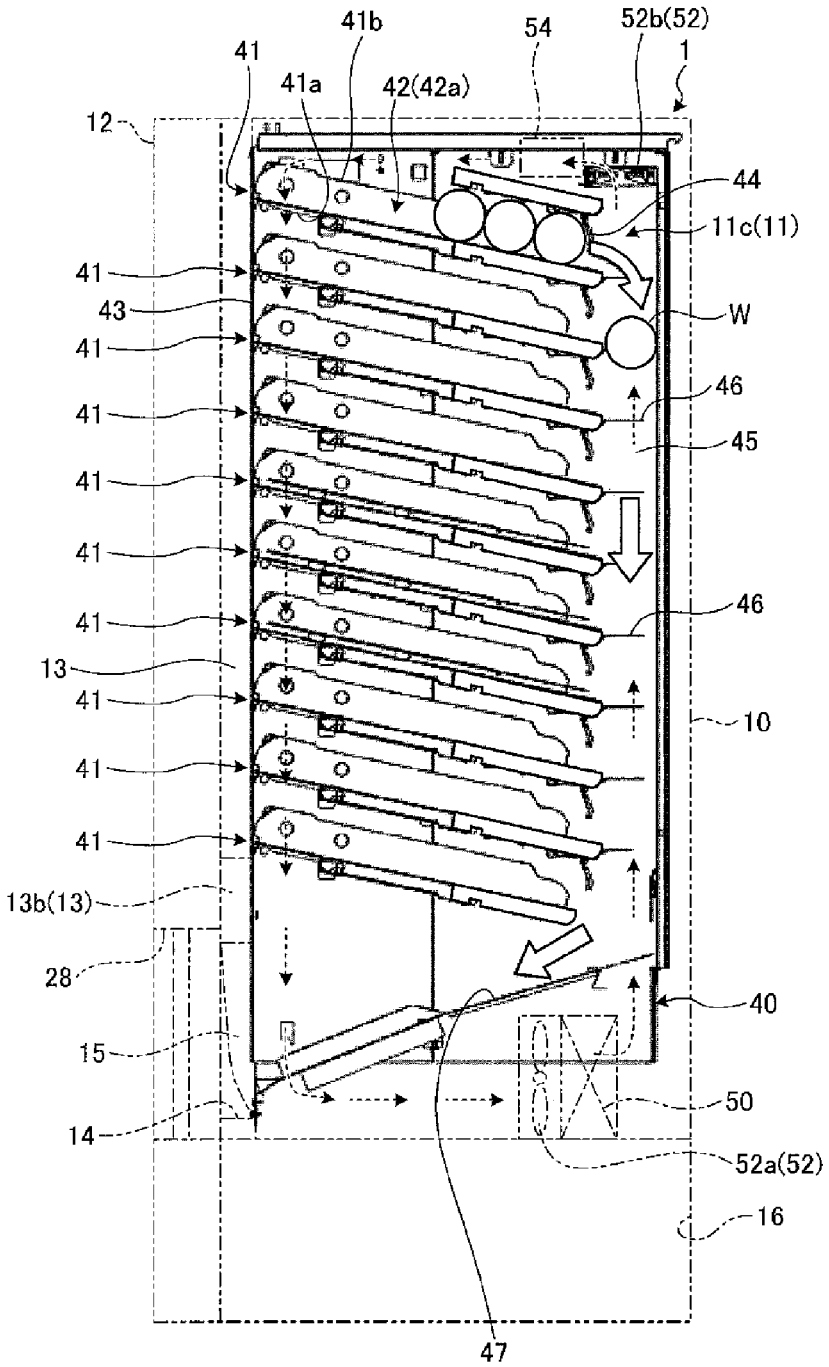

[Figure 4]
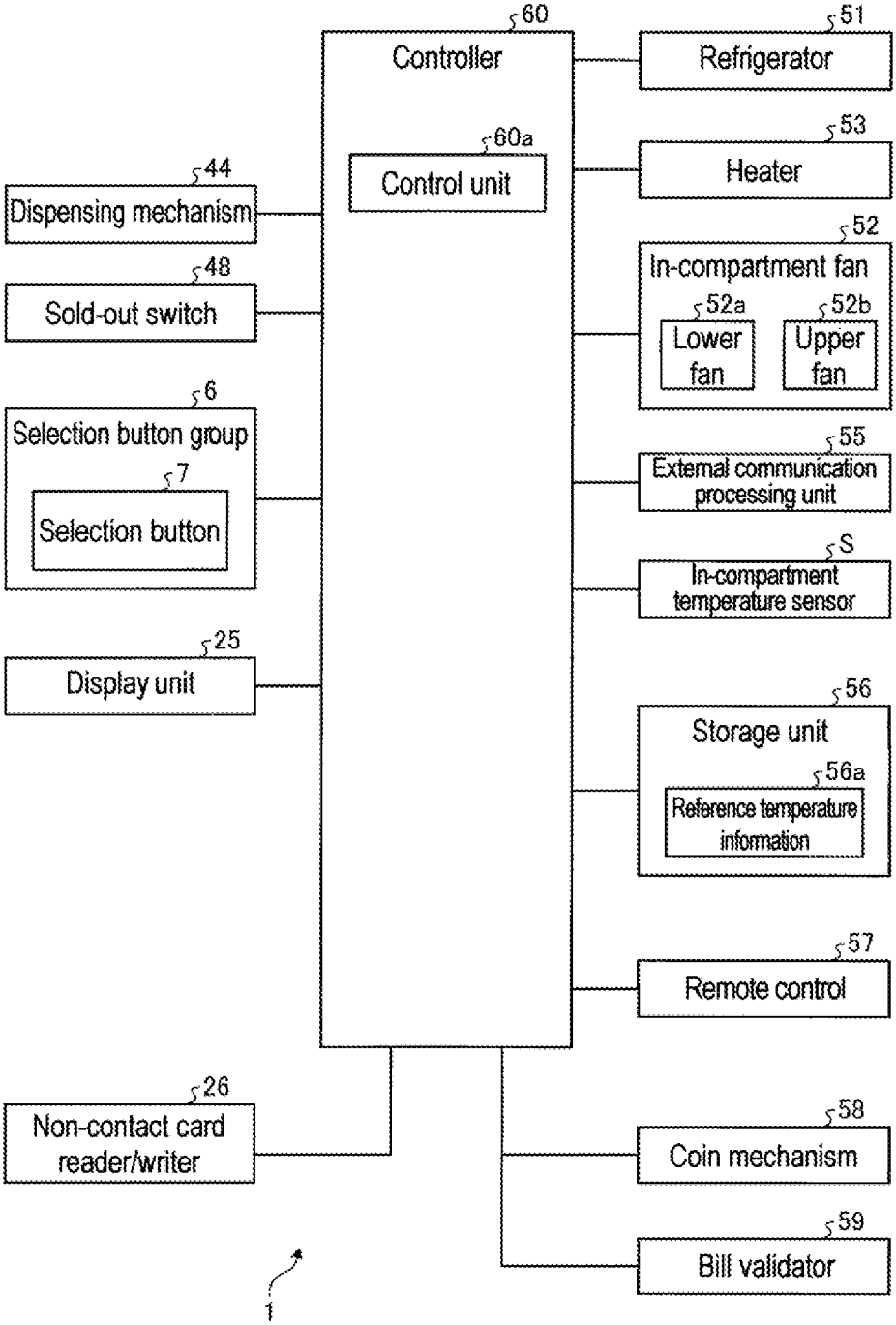

[Figure 5]
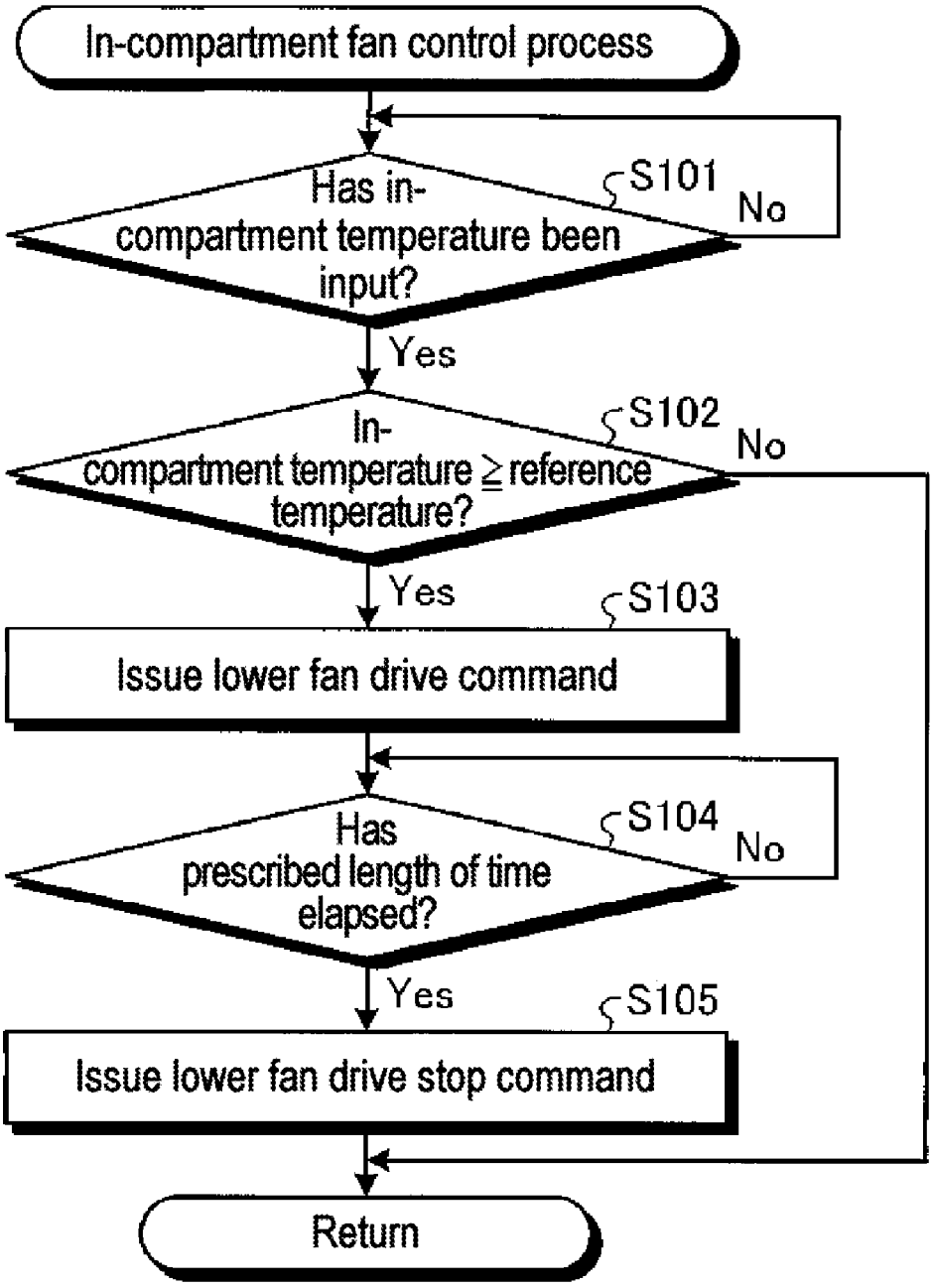

PRODUCT ACCOMMODATING DEVICE

TECHNICAL FIELD

The present invention relates to a product accommodating device, and more specifically relates to a product accommodating device that accommodates products such as beverages contained in containers such as cans or PET bottles.

BACKGROUND ART

Conventionally-known product accommodating devices for accommodating products such as beverages contained in containers such as cans or PET bottles include automatic vending machines for selling said products. Such automatic vending machines are provided with a main body cabinet, which is the main body of the automatic vending machine. The main body cabinet is formed as a heat-insulating housing in the shape of a cuboid of which the front surface is open. The main body cabinet is provided on the front surface thereof with an external door and an internal door, and is internally provided with an accommodating compartment. The external door is for opening and closing the front surface opening of the main body cabinet. The internal door has a heat insulating construction, and is for opening and closing the front surface of the accommodating compartment. The accommodating compartment has a heat insulating construction, and is internally provided with an evaporator, an in-compartment fan, and a product rack.

The evaporator cools the air surrounding the evaporator itself, and forms a refrigeration cycle together with a compressor, a condenser, and the like, provided outside the accommodating compartment. The product rack is referred to as a so-called serpentine-type product rack in which a plurality of product columns, which accommodate inserted products in a meandering shape in the vertical direction, are provided in the front-rear direction. With such a product rack, when a sell command is issued, the most downstream product, positioned lowermost in the corresponding product column, is dispensed, and can be removed through a product removal port provided in the external door.

In the abovementioned automatic vending machine, air that has been cooled by the evaporator is blown by driving the compressor and the in-compartment fan, thereby cooling the internal atmosphere of the accommodating compartment. As a result, the products accommodated in the product rack are cooled. Furthermore, with the abovementioned vending machine, it is known to perform a forced-stop operation to forcibly stop the driving of the compressor and the in-compartment fan during a certain defined time period in order to reduce power consumption (see patent literature article 1, for example).

PRIOR ART LITERATURE

Patent Literature

Patent literature article 1: Japanese Unexamined Patent Application Publication H4-267498

SUMMARY OF THE INVENTION

Problems to be Resolved by the Invention

Now, depending on the automatic vending machine, it is known to provide a product rack referred to as a so-called slant rack, instead of the serpentine-type product rack discussed hereinabove. Such a product rack is configured by providing, in a plurality of levels in the vertical direction, product columns in which products are accommodated lying down side-by-side in a row in an accommodating passage that extends in an inclined manner in such a way as to become gradually lower from the upstream side toward the downstream side. That is, such a product rack has a configuration in which the product columns are provided in such a way that the most downstream products therein are aligned in the vertical direction.

Therefore, if a forced-stop operation is carried out as discussed hereinabove, natural convection inside the accommodating compartment and differences in the amount of heat penetration from outside the main body cabinet, for example, may cause an increase in temperature variation, which is the temperature difference between the most downstream products in the lower product columns and the most downstream products in the higher product columns.

The present invention takes account of the abovementioned situation, and the objective thereof is to provide an automatic vending machine with which a temperature variation between the most downstream products in each product column can be reduced while achieving a reduction in power consumption.

Means of Overcoming the Problems

In order to achieve this objective, a product accommodating device according to the present invention is provided with an accommodating compartment having a heat insulating construction, in which a plurality of product columns accommodating products aligned in a row are provided in a plurality of levels in such a way that the respective most downstream products are aligned in the vertical direction, and a blowing means for adjusting the internal atmosphere in the accommodating compartment to a prescribed temperature by blowing air that has been adjusted by means of a temperature adjusting means disposed in the accommodating compartment, and is characterized by being provided with a control means which causes the blowing means to be driven for only a predefined time, if the in-compartment temperature of the accommodating compartment becomes equal to or greater than a predefined reference temperature, in a state in which the drive of the temperature adjusting means and the blowing means has been stopped.

Further, according to the present invention, the product accommodating device is characterized in that the product columns accommodate the products lying down side-by-side in a row in an accommodating passage that extends in an inclined manner in such a way as to become gradually lower from the upstream side toward the downstream side.

Further, according to the present invention, the product accommodating device is characterized in that the temperature adjusting means is disposed in a lower portion of the accommodating compartment and cools the air surrounding the temperature adjusting means itself.

Further, according to the present invention, the product accommodating device is characterized in that the blowing means is disposed in the vicinity of the temperature adjusting means in the lower portion of the accommodating compartment.

Further, according to the present invention, the product accommodating device is characterized in that the temperature adjusting means comprises a refrigerator and an evaporator.

Further, according to the present invention, the product accommodating device is characterized in that the blowing means is an in-compartment fan.

Advantages of the Invention

According to the present invention, the control means causes the blowing means to be driven for only a predefined time, if the in-compartment temperature of the accommodating compartment becomes equal to or greater than a predefined reference temperature, in a state in which the drive of the temperature adjusting means and the blowing means has been stopped, and therefore the internal air on the lower side of the accommodating compartment and the internal air on the upper side thereof are sufficiently mixed, making it possible to achieve a substantially uniform temperature throughout the entire accommodating compartment, and the ambient temperature of the most downstream products in each product column can also be made substantially uniform. The present invention therefore exhibits the advantage that it is possible to reduce the temperature variation between the most downstream products in each product column while achieving a reduction in power consumption.

BRIEF EXPLANATION OF THE DRAWINGS

FIG. 1 is a front elevation illustrating the configuration of an automatic vending machine, being an embodiment of the present invention.

FIG. 2 is an oblique view illustrating the internal structure of the automatic vending machine illustrated in FIG. 1.

FIG. 3 is a cross-sectional side view illustrating the internal structure of the automatic vending machine illustrated in FIG. 1.

FIG. 4 is a block diagram illustrating schematically a characteristic control system of the automatic vending machine illustrated in FIG. 1.

FIG. 5 is a flowchart illustrating the processing content of in-compartment fan control processing implemented by a control unit of a controller during a forced-stop operation.

DESCRIPTION OF EMBODIMENTS

A preferred embodiment of the product accommodating device according to the present invention will now be described in detail with reference to the accompanying drawings. Hereinafter, the product accommodating device is described in terms of an automatic vending machine for selling accommodated products.

FIG. 1 is a front elevation illustrating the configuration of the automatic vending machine, being an embodiment of the present invention. FIG. 2 and FIG. 3 each illustrate the internal structure of the automatic vending machine illustrated in FIG. 1, where FIG. 2 is an oblique view, and FIG. 3 is a cross-sectional side view. FIG. 4 is a block diagram illustrating schematically a characteristic control system of the automatic vending machine illustrated in FIG. 1.

The automatic vending machine 1 illustrated here by way of example sells, as products, beverages contained in containers such as cans or PET bottles, for example, and is provided with a front surface door 12 on the front surface of a main body cabinet 10 in which the products are accommodated. The front surface door 12 is supported on the main body cabinet 10 by way of one side edge portion, and is capable of opening and closing a front surface opening in the main body cabinet 10. An exhibiting chamber 2 is provided in the front surface door 12.

The exhibiting chamber 2 is for exhibiting, in the interior thereof, a plurality of product samples D, and is formed in a rectangular shape with the front surface open. In the exhibiting chamber 2, stages 5 are provided in a plurality of levels (four levels in the example in FIG. 1) in the vertical direction, and a plurality of product samples D (a total of 42 in the example in FIG. 1) are provided upright, side-by-side, on each stage 5.

The front surface opening of the exhibiting chamber 2 is covered by a transparent resin panel 4, such that foreign matter is prevented from entering from the outside while the interior can be seen through the resin panel 4. Further, selection buttons 7 corresponding to each product sample D are provided in the resin panel 4. That is, four selection button groups 6 are disposed side-by-side in the vertical direction in such a way as to correspond to the stages 5.

A coin insertion port 21, a banknote insertion port 22, a return lever 23, a pop-up handle 24, a display unit 25, and a non-contact card reader/writer are disposed in the front surface door 12 to the right of the exhibiting chamber 2, and a coin return port 27 and a product removal port 28 are disposed below the exhibiting chamber 2. The display unit 25 displays various types of information relating to the purchase of a product, such as the amount of money that has been inserted. The non-contact card reader/writer reads or writes electronic money information. The product removal port 28 is an opening for a user to remove a purchased product. It should be noted that reference number 3 in FIG. 1 refers to an advertisement arrangement portion provided inside the exhibiting chamber 2.

A plurality (three in the illustrated example) of accommodating compartments 11*a*, 11*b*, 11*c* are provided side-by-side in the left-right direction inside the main body cabinet 10. The accommodating compartments 11*a*, 11*b*, 11*c* are provided in such a way as to face the front surface opening of the main body cabinet 10, and are chambers having a heat insulating construction that accommodate the products in a state in which a desired temperature is maintained.

The front surface openings of the accommodating compartments 11*a*, 11*b*, 11*c* are opened and closed by means of a heat insulating door 13 provided in such a way as to be capable of swinging about one side edge portion of the main body cabinet 10. The heat insulating door 13 has a configuration divided into upper and lower parts, and product discharging ports 14 corresponding to each accommodating compartment 11*a*, 11*b*, 11*c*, and product discharging doors 15 which open and close the product discharging ports 14 are provided in a lower door 13*b*.

A product rack 40, an evaporator 50, an in-compartment fan 52, and a cold storage material 54 are provided in each accommodating compartment 11*a*, 11*b*, 11*c*. The product racks 40 have a configuration in which a plurality (for example, ten) of product shelves 41 are provided in a plurality of levels in the vertical direction. The product shelves 41 each include a shelf plate 41*a* which is inclined gradually downward from the front toward the rear, and product columns 42 are provided on the upper surfaces of the shelf plates 41*a*. One product column 42 may be provided on the upper surface of the shelf plate 41*a*, or a plurality of product columns 42 may be provided on the upper surface of the shelf plate 41*a*. If a plurality of product columns 42 are provided on the upper surface of the shelf plate 41*a*, the product columns 42 are disposed side-by-side in the left-right direction by providing a shelf guide 41*b* upright on the upper surface of the shelf plate 41*a*.

Such a product column 42 is known as a slant column, and includes an accommodating passage 42*a* which extends in the front-rear direction, wherein products inserted from an insertion port 43 at the front end of the accommodating passage 42*a* are accommodated lying down in a row along the accommodating passage 42*a*. In this product column 42, the extension length of the accommodating passage 42*a* is the same as the extension length of the accommodating passages 42*a* in the other product columns 42, and the number of products that can be accommodated is the same as in the other product columns 42.

That is, in the accommodating compartments 11*a*, 11*b*, 11*c*, the plurality of product columns 42 accommodating the products aligned in a row are provided in a plurality of levels in such a way that the respective most downstream products are aligned in the vertical direction.

A dispensing mechanism 44 is provided in the product column 42 at the rear end of the accommodating passage 42*a*. When a driving force from a motor (not shown in the drawings) that is either individual or is common to the other dispensing mechanisms 44 is imparted to the dispensing mechanism 44, the most downstream product positioned rearmost among the products accommodated in the accommodating passage 42*a* is dispensed to a fall passage 45 to the rear of the product rack 40.

The product that has been dispensed into the fall passage 45 by the dispensing mechanism 44 rolls along a discharge chute 47 that is inclined gradually downward from the lower end of the fall passage 45 toward the front, and is guided through the product discharging port 14 to the product removal port 28. It should be noted that reference number 46 in FIG. 3 refers to braking plates provided at the rear end of each product shelf 41. The braking plates 46 allow the product that is falling through the fall passage 45 to fall, while reducing the speed of the product.

The evaporators 50 are installed in regions below the discharge chute 47 in the accommodating compartments 11*a*, 11*b*, 11*c*. In conjunction with a refrigerator 51 (see FIG. 4) installed in a machine chamber 16, which is a chamber below the accommodating compartments 11*a*, 11*b*, 11*c* inside the main body cabinet 10, the evaporator 50 forms a refrigerant circuit that circulates a refrigerant. Each evaporator 50 causes heat to be exchanged between a low-temperature low-pressure refrigerant that passes through a refrigerant flow passage in the evaporator 50, and the surrounding air, and the refrigerant that passes through the refrigerant flow passage vaporizes, thereby cooling the surrounding air.

A plurality (two in the example in FIG. 3) of in-compartment fans 52 are provided, including a lower fan 52*a* and an upper fan 52*b*. The lower fan 52*a* is installed in front of the evaporator 50. The upper fan 52*b* is installed at the upper end of the fall passage 45.

The cold storage material 54 is installed in an upper portion of the accommodating compartment 11*a*, 11*b*, 11*c*, in other words in front of the upper fan 52*b*. The cold storage material 54 is configured by sealing a cold storage agent such as water or a gelling agent inside a container. The cold storage agent in the cold storage material 54 is cooled by air that has been cooled by the evaporator 50 and that has passed through the fall passage 45 as a result of the in-compartment fans 52 being driven, and stores coldness. It should be noted that in the present embodiment, the cold storage material 54 is installed in front of the upper fan 52*b*, but there is no particular restriction to the installation location of the cold storage material 54, provided that the products accommodated in the product rack 40 can be satisfactorily cooled thereby.

As illustrated in FIG. 4, in the automatic vending machine 1, the refrigerator 51, a heater 53, the dispensing mechanisms 44, the in-compartment fans 52, sold-out switches 48, the selection button groups 6 comprising the selection buttons 7, the display unit 25, the non-contact card reader/writer 26, an external communication processing unit 55, in-compartment temperature sensors S, a storage unit 56, a remote control 57, a coin mechanism 58, and a bill validator 59 are connected to a controller 60.

The refrigerator 51 forms the refrigerant circuit in conjunction with the evaporator 50 discussed hereinabove, and includes a compressor for sucking and compressing the refrigerant that has been vaporized by the evaporator 50, and a condenser for condensing the refrigerant that has been compressed by the compressor. The heater 53 is installed in the accommodating compartments 11*a*, 11*b* other than the accommodating compartment 11*c* on the right. The heater 53 is a heating means which adopts an energized state when driven, to heat the surrounding air. The sold-out switches 48 are installed in each product column 42 to detect a sold-out condition in the corresponding product column 42.

The external communication processing unit 55 performs processing to connect to an external network, which is not shown in the drawing, and short-range radio communication connection processing such as WiFi (registered trademark). The in-compartment temperature sensors S are installed on the upper side of each accommodating compartment 11*a*, 11*b*, 11*c*, to detect in-compartment temperatures, which are the internal temperatures in the accommodating compartments 11*a*, 11*b*, 11*c*. Such an in-compartment temperature sensor S provides the detected in-compartment temperature as a signal to the controller 60.

The storage unit 56 stores and saves various types of information. Reference temperature information 56*a* used in in-compartment fan control processing, discussed hereinafter, is stored in the storage unit 56. The reference temperature information 56*a* includes reference information serving as a threshold for starting to drive the in-compartment fans 52, in the in-compartment fan control processing.

The remote control 57 is an input/output unit that is connected by wire to the controller 60. The coin mechanism 58 is a coin processing device, and performs deposit processing and the like of deposited coins that have been inserted though the coin insertion port 21. The coin mechanism 58 delivers coins to the coin return port 27 if there is change, and delivers coins that have been deposited through the coin insertion port 21 to the coin return port 27 if the return lever 23 has been operated. The bill validator 59 is a banknote processing device, and performs deposit processing and the like of banknotes that have been inserted through the banknote insertion port 22. The controller 60 includes a control unit 60*a*. The control unit 60*a* performs overall control of each connected unit.

In the automatic vending machine 1 configured as described hereinabove, the internal air in each accommodating compartment 11*a*, 11*b*, 11*c* can be circulated, as illustrated by the dashed arrows in FIG. 3, by driving the refrigerator 51 and driving the in-compartment fans 52 (lower fan 52*a* and upper fan 52*b*). That is, air that has been cooled by the evaporator 50 passes through the fall passage 45 from the bottom toward the top, and the air that has passed through the fall passage 45 passes toward the front through the upper portion of the accommodating compartment 11*a*, 11*b*, 11*c*, and then passes downward and once again reaches the evaporator 50. As a result of the internal air in the accommodating compartments 11*a*, 11*b*, 11*c* being circulated in this way, the products accommodated in each product column 42 can be cooled to a prescribed temperature.

Furthermore, in the automatic vending machine 1, when a predefined cooling down operation start time is reached, a cooling down operation is performed to cool the products in the product column 42 sufficiently by increasing the rotational speed of the in-compartment fans 52, and when a predefined drive stop time is subsequently reached, a forced-stop operation is performed to stop the drive of the refrigerator 51 and the in-compartment fans 52 until a predetermined cancellation time is reached. As a result, the in-compartment temperature in the accommodating compartments 11*a*, 11*b*, 11*c*, in particular on the upper side thereof, transitions in a gradually rising direction as a result of natural convection and the like.

FIG. 5 is a flowchart illustrating the processing content of the in-compartment fan control processing implemented by the control unit of the controller during the forced-stop operation. It should be noted that the following description relates to the accommodating compartment 11*c* on the left.

In the in-compartment fan control process, the control unit 60*a* of the controller 60 waits for input of the in-compartment temperature from the in-compartment temperature sensor S (step S101). If the in-compartment temperature has been input (step S101: Yes), the control unit 60*a* reads the reference temperature information 56*a* from the storage unit 56 and determines whether or not the in-compartment temperature is equal to or greater than the reference temperature (step S102).

If the in-compartment temperature is less than the reference temperature (step S102: No), the control unit 60*a* determines that the in-compartment temperature on the upper side of the accommodating compartment 11*c* has not increased significantly, and returns the procedure without implementing the processing discussed hereinafter, thereby ending the current process.

Meanwhile, if the in-compartment temperature is equal to or greater than the reference temperature (step S102: Yes), the control unit 60*a* issues a drive command to the lower fan 52*a* (step S103). As a result, the lower fan 52*a* is driven to circulate the internal air in the accommodating compartment 11*c*. As a result, the internal air on the lower side of the accommodating compartment 11*c* and the internal air on the upper side thereof are mixed.

Having caused the lower fan 52*a* to be driven in this way, the control unit 60*a* uses a built-in timing unit to determine whether a predetermined time (for example, 30 minutes) has elapsed since the lower fan 52*a* was driven (step S104), and if it is determined that the predetermined time has elapsed (step S104: Yes), sends a drive stop command to the lower fan 52*a* (step S105), and then returns the procedure, thereby ending the current process.

In this way, the internal air on the lower side of the accommodating compartment 11*c* and the internal air on the upper side thereof are sufficiently mixed, making it possible to achieve a substantially uniform temperature throughout the entire accommodating compartment 11*c*.

As described hereinabove, according to the automatic vending machine 1, which is an embodiment of the present invention, the control means 60*a* causes the lower fan 52*a* to be driven for only a predefined time, if the in-compartment temperature of the accommodating compartment 11*a*, 11*b*, 11*c* detected by the in-compartment temperature sensor S becomes equal to or greater than the reference temperature, in a state in which the drive of the refrigerator 51 and the in-compartment fan 52 has been stopped, and it is therefore possible to achieve a substantially uniform temperature throughout the entire accommodating compartment 11*a*, 11*b*, 11*c*, and the ambient temperature of the most downstream products in each product column can also be made substantially uniform. It is therefore possible to reduce the temperature variation between the most downstream products in each product column 42 while achieving a reduction in power consumption.

A preferred embodiment of the present invention has been described hereinabove, but the present invention is not restricted thereto, and various modifications can be made.

In the embodiment discussed hereinabove, the refrigerator 51 and the evaporator 50 are described as being the temperature adjusting means for adjusting the in-compartment temperature of the accommodating compartments 11*a*, 11*b*, 11*c* to a prescribed temperature, but in the present invention the heater 53 may be the temperature adjusting means.

In the embodiment discussed hereinabove, the in-compartment fan control process causes the lower fan 52*a* to be driven, but in the present invention, the upper fan 52*b* may be driven in addition to the lower fan 52*a*, or the upper fan 52*b* may be driven instead of the lower fan 52*a*.

In the embodiment discussed hereinabove, the automatic vending machine 1 was presented as an example of a product accommodating device, but in the present invention, the product accommodating device may also be a showcase or the like.

EXPLANATION OF THE REFERENCE NUMBERS

1 . . . automatic vending machine, 10 . . . main body cabinet, 11*a*, 11*b*, 11*c* . . . accommodating compartment, 12 . . . front surface door, 40 . . . product rack, 41 . . . product shelf, 42 . . . product column, 42*a* . . . accommodating passage, 44 . . . dispensing mechanism, 45 . . . fall passage, 50 . . . evaporator, 51 . . . refrigerator, 52 . . . in-compartment fan, 52*a* . . . lower fan, 52*b* . . . upper fan, 54 . . . cold storage material, 60 . . . controller, 60*a* . . . control unit, S . . . in-compartment temperature sensor.

The invention claimed is:

1. A product accommodating device provided with an accommodating compartment having a heat insulating construction, in which a plurality of product columns accommodating products aligned in a row are provided in a plurality of levels, and a blowing means for adjusting the internal atmosphere in the accommodating compartment to a prescribed temperature by blowing air that has been adjusted by means of a temperature adjusting means disposed in the accommodating compartment, wherein:

a control means which causes a forced stop of the blowing means and the temperature adjusting means once a predefined drive stop time is reached, but if the in-compartment temperature of the accommodating compartment becomes equal to or greater than a predefined reference temperature during the forced stop, then causing the blowing means to be driven for a predefined time.

2. The product accommodating device as claimed in claim 1, characterized in that the product columns accommodate the products lying down side-by-side in a row in an accommodating passage that extends in an inclined manner in such a way as to become gradually lower from the upstream side toward the downstream side.

3. The product accommodating device as claimed in claim 1, characterized in that the temperature adjusting means is disposed in a lower portion of the accommodating compartment and cools the air surrounding the temperature adjusting means itself.

4. The product accommodating device as claimed in claim 3, characterized in that the blowing means is disposed in the vicinity of the temperature adjusting means in the lower portion of the accommodating compartment.

5. The product accommodating device as claimed in claim 3, characterized in that the temperature adjusting means comprises a refrigerator and an evaporator.

6. The product accommodating device as claimed in claim 4, characterized in that the blowing means is an in-compartment fan.

7. A vending machine having a product compartment, comprising:

an evaporator;

a fan for adjusting the temperature in the product compartment to a prescribed temperature by blowing air that has been adjusted by the evaporator; and a controller that causes a forced stop of the evaporator and the fan once a predefined drive stop time is reached, but if the temperature of the product compartment becomes equal to or greater than a predefined reference temperature during the forced stop, then causing the fan to be driven for a predefined time.

* * * * *